US006918360B2

(12) United States Patent
Sun et al.

(10) Patent No.: US 6,918,360 B2
(45) Date of Patent: Jul. 19, 2005

(54) ENGINE VALVE ACTUATOR ASSEMBLY WITH HYDRAULIC FEEDBACK

(75) Inventors: Zongxuan Sun, Troy, MI (US); Norman Kenneth Bucknor, Troy, MI (US); Jie Tong, Warren, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/405,965

(22) Filed: Apr. 2, 2003

(65) Prior Publication Data

US 2004/0194741 A1 Oct. 7, 2004

(51) Int. Cl.[7] ..... F01L 9/02
(52) U.S. Cl. ..... 123/90.12; 123/90.15
(58) Field of Search ..... 123/90.12–90.15, 123/90.48–90.59; 91/374, 378, 52, 469, 365

(56) References Cited

U.S. PATENT DOCUMENTS

| | | | | |
|---|---|---|---|---|
| 1,703,858 A | | 3/1929 | Banner | |
| 3,157,166 A | | 11/1964 | MacNeill | |
| 4,009,695 A | | 3/1977 | Ule | |
| 4,459,946 A | | 7/1984 | Burandt | |
| 5,373,818 A | | 12/1994 | Unger | |
| 5,546,222 A | | 8/1996 | Plaessmann et al. | |
| 5,572,961 A | * | 11/1996 | Schechter et al. | 123/90.12 |
| 5,638,781 A | | 6/1997 | Sturman | |
| 5,881,689 A | * | 3/1999 | Hochholzer | 123/90.12 |
| 6,109,284 A | | 8/2000 | Johnson et al. | |
| 6,112,711 A | | 9/2000 | Shimizu et al. | |
| 6,263,842 B1 | | 7/2001 | DeOjeda et al. | |
| 6,505,584 B2 | * | 1/2003 | Lou | 123/90.12 |
| 6,688,267 B1 | | 2/2004 | Raghavan | |
| 2003/0015155 A1 | | 1/2003 | Turner et al. | |
| 2003/0172885 A1 | | 9/2003 | Gaessler et al. | |

* cited by examiner

*Primary Examiner*—Thomas Denion
*Assistant Examiner*—Jaime Corrigan
(74) *Attorney, Agent, or Firm*—Kathryn A. Marra

(57) ABSTRACT

A valve actuator assembly for an engine includes a movable engine valve and a movable spool valve. The valve actuator assembly also includes a driving channel interconnecting the spool valve and the engine valve and a feedback channel interconnecting the spool valve and the engine valve. The valve actuator assembly includes an actuator operatively cooperating with the spool valve to position the spool valve to prevent and allow fluid flow in and out of the driving channel to position the engine valve. The valve actuator assembly further includes an on/off valve in fluid communication with the feedback channel to enable and disable the feedback channel to control motion of the spool valve.

20 Claims, 2 Drawing Sheets

ENGINE VALVE ACTUATOR ASSEMBLY WITH HYDRAULIC FEEDBACK

TECHNICAL FIELD

The present invention relates generally to intake or exhaust valve actuators for engines and, more particularly, to a valve actuator assembly with hydraulic feedback for an internal combustion engine.

BACKGROUND OF THE INVENTION

It is known to provide a valve train or valve actuator assembly for an engine such as an internal combustion engine of a vehicle such as a motor vehicle. Typically, the valve train includes one or more valves, a cam shaft having one or more cams, and a tappet contacting each cam and valve. Typically, engine valve actuation is accomplished via the engine-driven camshaft. However, this type of valve actuation introduces constraints on valve operation that preclude optimal valve opening and closing schedules, compromising engine performance, fuel economy, and emissions.

It is also known to provide a camless valve train for an internal combustion engine. An example of such a camless valve train is disclosed in the prior art. For example, a camless intake/exhaust valve for an internal combustion engine is controlled by a solenoid actuated fluid control valve. The control valve has a pair of solenoids that move a spool. The solenoids are digitally latched by short digital pulses provided by a microcontroller.

One disadvantage of some camless valve trains is their poor controllability due to open loop instability, which causes great difficulty in their operation. Another disadvantage of some camless valve trains is that they do not provide full capability for variable lift. Further disadvantages of some camless valve trains are that they have relatively high cost, large size, high energy consumption, low repeatability from cycle to cycle and cylinder to cylinder, hard seating impact, and high seating velocity induced noise.

As a result, it is desirable to provide a valve actuator assembly for an engine that improves controllability. It is also desirable to provide a valve actuator assembly for an engine having more flexibility and full capacity for variable lift. It is further desirable to provide a valve actuator assembly for an engine that reduces energy consumption and provides satisfactory seating velocity. Therefore, there is a need in the art to provide a valve actuator assembly for an engine that meets these desires.

SUMMARY OF THE INVENTION

It is, therefore, one object of the present invention to provide a new camless valve actuator assembly for an engine.

It is another object of the present invention to provide a valve actuator assembly for an engine that has hydraulic feedback for controllability.

To achieve the foregoing objects, the present invention is a valve actuator assembly for an engine. The valve actuator assembly includes a movable engine valve and a movable spool valve. The valve actuator assembly also includes a driving channel interconnecting the spool valve and the engine valve and a feedback channel interconnecting the spool valve and the engine valve. The valve actuator assembly includes an actuator operatively cooperating with the spool valve to position the spool valve to prevent and allow fluid flow in and out of the driving channel to position the engine valve. The valve actuator assembly further includes an on/off valve in fluid communication with the feedback channel to enable and disable the feedback channel to control motion of the spool valve.

One advantage of the present invention is that a valve actuator assembly is provided for an engine that has hydraulic feedback for precise motion by self-regulating flow control. Another advantage of the present invention is that the valve actuator assembly has controllability that is open loop stable with automatic regulation. Yet another advantage of the present invention is that the valve actuator assembly is an enabler for improved valve train stability without sacrificing dynamic performance. Still another advantage of the present invention is that the valve actuator assembly is an enabler for improved engine performance, improved engine fuel economy by lowering fuel consumption, and improved engine emissions by lowering emissions. A further advantage of the present invention is that the valve actuator assembly minimizes energy consumption by self-regulation flow control, a simple spool valve, and efficient valve control to minimize throttling of the fluid flow. Yet a further advantage of the present invention is that the valve actuator assembly has uses one solenoid and one on/off valve. Still a further advantage of the present invention is that the valve actuator assembly has a relatively small size and is easy to package in an engine. Another advantage of the present invention is that the valve actuator assembly has a relatively low cost. Yet another advantage of the present invention is that the valve actuator assembly has improved output torque and built-in soft landing capability to reduce noise and improve durability.

Other objects, features, and advantages of the present invention will be readily appreciated, as the same becomes better understood, after reading the subsequent description taken in conjunction with the accompanying drawings.

DESCRIPTION OF THE PREFERRED EMBODIMENTS

Figure 1:
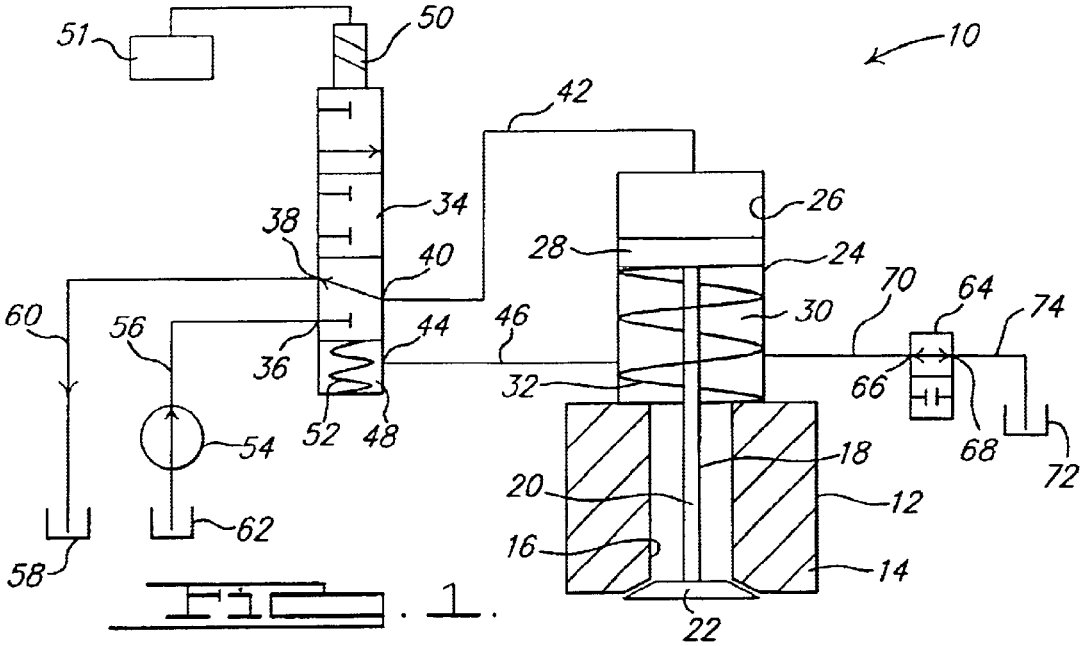
FIG. 1 is a diagrammatic view of a valve actuator assembly, according to the present invention, illustrated in operational relationship with an engine of a vehicle.
Figure 2:
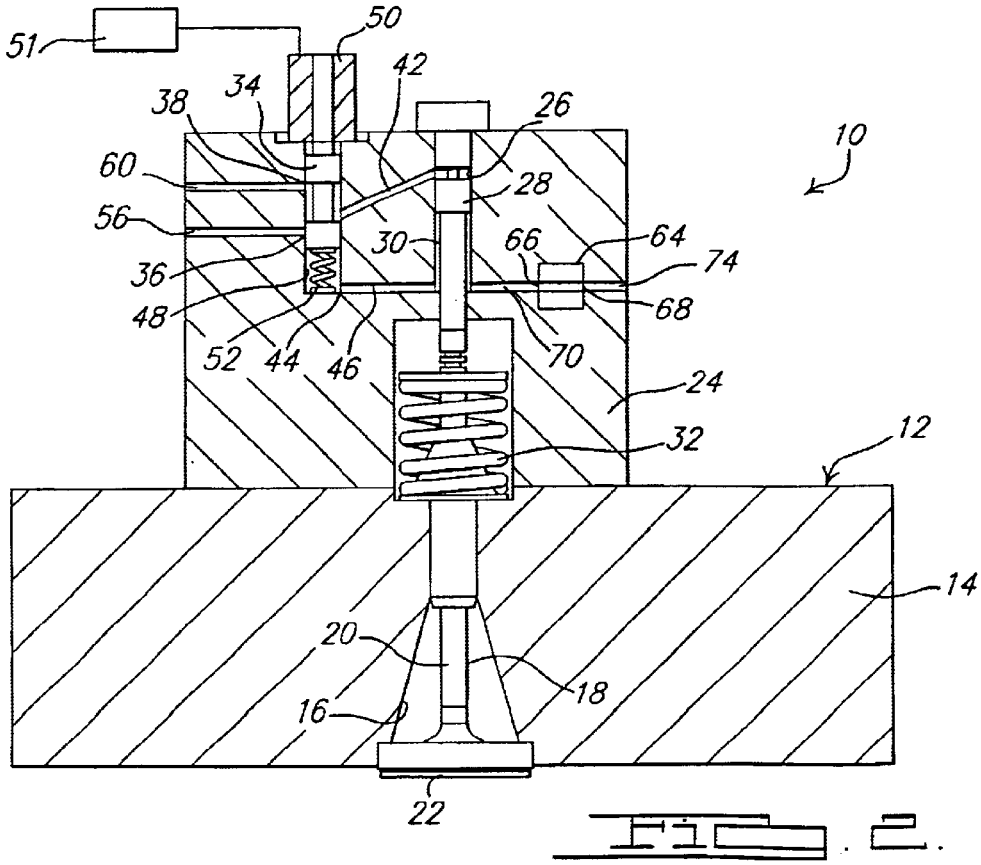
FIG. 2 is a fragmentary view of the valve actuator assembly of FIG. 1 in an engine valve closed position.
Figure 3:
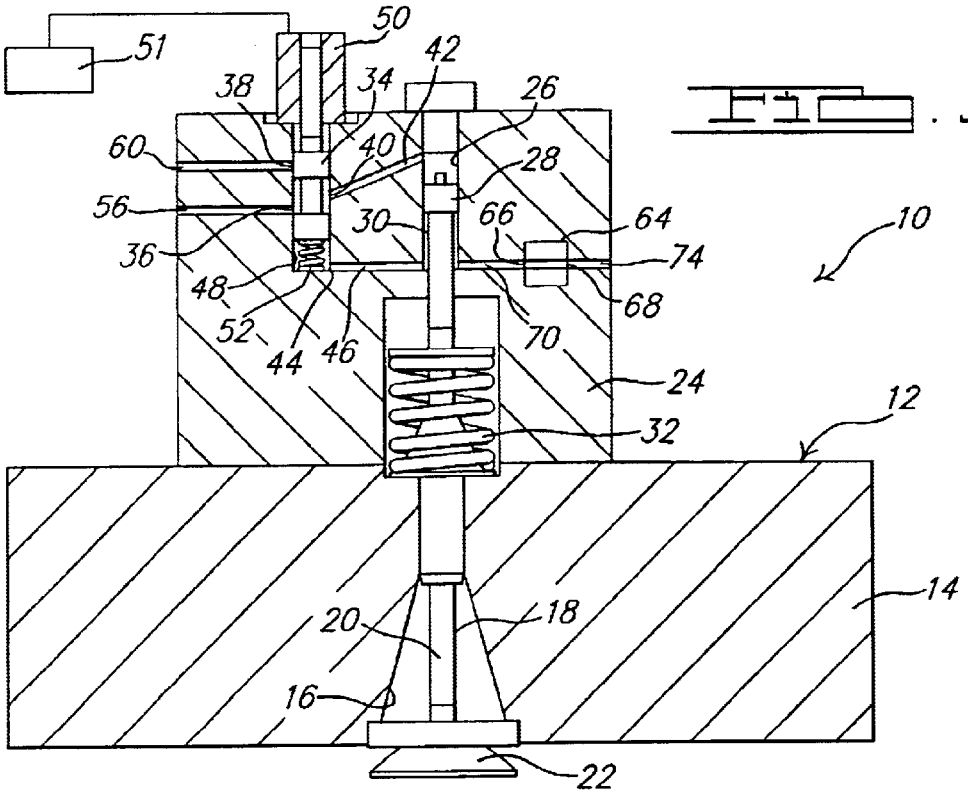
FIG. 3 is a view similar to FIG. 2 illustrating the valve actuator assembly in an engine valve part opened position.
Figure 4:
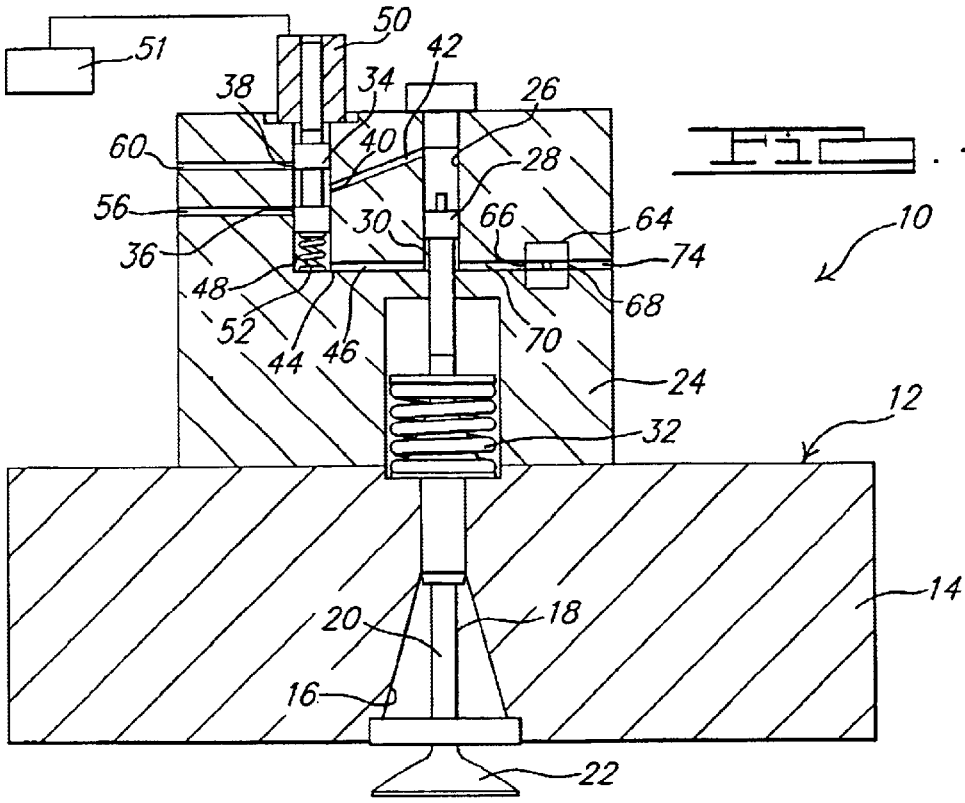
FIG. 4 is a view similar to FIG. 2 illustrating the valve actuator assembly in an engine valve fully opened position.

Referring to the drawings and in particular FIG. 1, one embodiment of a valve actuator assembly 10, according to the present invention, is shown for an engine, generally indicated at 12, of a vehicle (not shown). The engine 12 is of an internal combustion type. The engine 12 includes an engine block 14 having at least one opening 16 therein in communication with at least one internal combustion chamber (not shown). The engine 12 also includes a movable engine valve 18 for each opening 16. The engine valve 18 has a valve stem 20 and a valve head 22 at one end of the valve stem 20. The engine valve 18 is movable to open and close its respective opening 16 between an open position as illustrated in FIGS. 3 and 4 and a closed position as illustrated in FIG. 2. It should be appreciated that the engine valve 18 may be either an intake or exhaust valve. It should also be appreciated that the valve actuator assembly 10 is a camless valve train for the engine 12. It should further be appreciated that, except for the valve actuator assembly 10, the engine 12 is conventional and known in the art.

The valve actuator assembly 10 includes a valve housing 24 disposed adjacent the engine block 14. The valve housing 24 has a first or primary fluid chamber 26 therein. The valve actuator assembly 10 also includes a piston 28 connected to or in contact with the engine valve 18 at the end of the valve stem 20 opposite the valve head 22. The piston 28 is disposed in the primary fluid chamber 26 of the valve housing 24 and forms a second or secondary fluid chamber 30 therein. The valve actuator assembly 10 includes an engine valve spring 32 disposed about the valve stem 20 and contacting the engine block 14 to bias the engine valve 18 toward the closed position of FIG. 2. It should be appreciated that the valve head 22 closes the opening 16 when the engine valve 18 is in the closed position.

The valve actuator assembly 10 also includes a spool valve 34 fluidly connected to the primary fluid chamber 26 and the secondary fluid chamber 30 of the valve housing 24. The spool valve 34 is of a three-position three-way type. The spool valve 34 has a high pressure port 36 and a low pressure port 38. The spool valve 34 also has a primary fluid chamber port 40 fluidly connected by a driving channel 42 to the primary fluid chamber 26 and a secondary fluid chamber port 44 fluidly connected by a feedback channel 46 to the secondary fluid chamber 30. The spool valve 34 also has a third or tertiary fluid chamber 48 at one end thereof fluidly connected to the secondary fluid chamber port 44. It should be appreciated that the spool valve 34 controls fluid flow with the primary fluid chamber 26.

The valve actuator assembly 10 includes an actuator 50 at one end of the spool valve 34 opposite the fluid chamber 48. The actuator 50 is of a linear type such as a solenoid electrically connected to a source of electrical power such as a controller 51. The valve actuator assembly 10 further includes a spool valve spring 52 disposed in the tertiary fluid chamber 48 to bias the spool valve 34 toward the actuator 50. It should be appreciated that the actuator 50 may be any suitable device that generates straight-line motion. It should also be appreciated that the controller 51 energizes and de-energizes the actuator 50 to move the spool valve 34.

The valve actuator assembly 10 also includes a fluid pump 54 and a high pressure line 56 fluidly connected to the pump 54 and the high pressure port 36. The valve actuator assembly 10 includes a fluid tank 58 and a low pressure line 60 fluidly connected to the tank 58 and the low pressure port 38. It should be appreciated that the pump 54 may be fluidly connected to the tank 58 or a separate fluid tank 62.

The valve actuator assembly 10 further includes an on/off valve 64 fluidly connected to the secondary fluid chamber 30 of the valve housing 24. The on/off valve 64 is of a two-way magnetically latchable type and is electrically connected to a source of electrical power such as the controller 51. The on/off valve 64 has a first port 66 and a second port 68. The first port 66 is fluidly connected by a channel 70 to the secondary fluid chamber 30. The valve actuator assembly 10 includes a fluid tank 72 fluidly connected to the second port 68 by a low pressure line 74. It should be appreciated that the fluid tank 72 is a low pressure source.

In operation of the valve actuator assembly 10, the engine valve 18 is shown in a closed position as illustrated in FIG. 2. At the closed position of the engine valve 18, the actuator 50 is de-energized by the controller 51 so that the spool valve spring 52 pushes the spool valve 34 upward and exposes the driving channel 42 to the low pressure line 60. The primary fluid chamber 26 is then connected to the low pressure line 60 through the driving channel 42. The engine valve spring 32 keeps the engine valve 18 closed with the valve head 22 closing the opening 16. The on/off valve 64 is open so that both the secondary fluid chamber 30 and the tertiary fluid chamber 48 are exposed to the fluid tank 72.

To open the engine valve 18, the controller 51 energizes the actuator 50 and causes the actuator 50 to overcome the force of the spool valve spring 52 and drive the spool valve 34 downward. The driving-channel 42 is then exposed to the high pressure line 56 and the high pressure fluid flows into the primary fluid chamber 26, which overcomes the force from the engine valve spring 32 and pushes the engine valve 18 open. The on/off valve 64 is open so that the secondary fluid chamber 30 and the tertiary fluid chamber 48 are exposed to the tank 72 as illustrated in FIG. 3. It should be appreciated that, in FIG. 3, the engine valve 18 is illustrated in a valve part open position.

To stop the engine valve 18 at a predetermined lift position, the controller 51 energizes the on/off valve 64 and the on/off valve 64 is closed, cutting off the fluid connection between the secondary fluid chamber 30 and the fluid tank 72. As the engine valve 18 continues to move downward, the piston 28 pushes the fluid in the secondary fluid chamber 30 via the feedback channel 46 into the tertiary fluid chamber 48, which drives the spool valve 34 upward. This motion continues until the spool valve 34 cuts off the fluid connection between the driving channel 42 and both the high pressure line 56 and the low pressure line 60. When the spool valve 34 reaches this equilibrium point, the engine valve 18 stops as illustrated in FIG. 4. It should be appreciated that, in FIG. 4, the engine valve 18 is illustrated in a valve open position.

To close the engine valve 18, the controller 51 de-energizes the actuator 50. The spool valve spring 52 then pushes the spool valve 34 upward and exposes the driving channel 42 to the low pressure line 60. The high pressure fluid in the primary fluid chamber 26 will exhaust into the low pressure line 60 and return to the fluid tank 58. The engine valve spring 32 drives the engine valve 18 back such that the valve head 22 closes the opening 16 as illustrated in FIG. 2. It should be appreciated that the on/off valve 64 is open so that the secondary fluid chamber 30 and tertiary fluid chamber 48 are connected to the fluid tank 72, causing the low pressure fluid to fill those chambers while the engine valve 18 moves upward. It should also be appreciated that the spool valve spring 34 may be eliminated and the actuator 50 may be of push/pull type to connect the driving channel 42 to the low pressure line 60.

The valve actuator assembly 10 of the present invention is made open-loop stable by utilizing the hydraulic feedback channel 46 and the on/off valve 64 is used to enable or disable the feedback channel 46. Open-loop stability implies that a system's response to a given input signal is not unbounded. The better controllability achieved by open loop stability enables it to provide better performance. The valve actuator assembly 10 of the present invention precisely controls the motion of the spool valve 34 through the feedback channel 46 so that it avoids unnecessary throttling of the low pressure flow and high pressure flow, thereby providing energy consumption benefit. It should be appreciated that the tertiary fluid chamber 48 and the feedback channel 46 can also be located on top of the spool valve 34 so that soft seating of the valve head 22 of the engine valve 18 can be achieved by the hydraulic feedback.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of operating a valve actuator assembly for a vehicle comprising:

providing a movable engine valve;

providing a movable spool valve;

actuating an actuator operatively cooperating with the spool valve and supplying a driving channel interconnecting the spool valve and the engine valve with fluid flow to move open the engine valve;

supplying a feedback channel interconnecting the spool valve and the engine valve with fluid flow; and enabling and disenabling the feedback channel via an on/off valve and controlling motion of the spool valve.

2. A valve actuator assembly for an engine of a vehicle comprising:

a movable engine valve;

a movable spool valve;

a driving channel interconnecting said spool valve and said engine valve;

a feedback channel interconnecting said spool valve and said engine valve;

an actuator operatively cooperating with said spool valve to position said spool valve to prevent and allow fluid flow in and out of said driving channel to position said engine valve; and an on/off valve in fluid communication with said feedback channel to enable and disable said feedback channel to control motion of said spool valve.

3. A valve actuator assembly as set forth in claim 1 including a valve housing.

4. A valve actuator assembly as set forth in claim 3 wherein said valve housing has a primary fluid chamber fluidly communicating with said driving channel and a secondary fluid chamber fluidly communicating with said feedback channel.

5. A valve actuator assembly as set forth in claim 4 including a piston operatively cooperating with said engine valve and being disposed in said valve housing and having said primary fluid chamber on one side and said secondary fluid chamber on an opposite side.

6. A valve actuator assembly as set forth in claim 4 including an on/off valve channel interconnecting said secondary fluid chamber and said on/off valve.

7. A valve actuator assembly as set forth in claim 1 including a low pressure fluid line connected to said spool valve.

8. A valve actuator assembly as set forth in claim 1 including a high pressure fluid line connected to said spool valve.

9. A valve actuator assembly as set forth in claim 1 including a fluid chamber at one end of said spool valve and fluidly communicating with said feedback channel.

10. A valve actuator assembly as set forth in claim 9 including a spool valve spring disposed in said fluid chamber to bias said spool valve toward said actuator.

11. A valve actuator assembly as set forth in claim 1 wherein said actuator is of a linear type to generate linear motion.

12. A valve actuator assembly as set forth in claim 11 including a controller electrically connected to said actuator to energize and de-energize said actuator.

13. A valve actuator assembly comprising:

a movable engine valve;

a movable spool valve;

a valve housing having a primary fluid chamber and a secondary fluid chamber;

a piston operatively cooperating with said engine valve and being disposed in said valve housing and having said primary fluid chamber on one side and said secondary fluid chamber on an opposite side;

a driving channel interconnecting said spool valve and said primary fluid chamber;

a feedback channel interconnecting said spool valve and said secondary fluid chamber;

an actuator operatively cooperating with said spool valve to position said spool valve to prevent and allow fluid flow in and out of said driving channel to position said engine valve; and an on/off valve in fluid communication with said feedback channel to enable and disable said feedback channel to stop said engine valve at a predetermined lift position.

14. A valve actuator assembly as set forth in claim 13 including an on/off valve channel interconnecting said secondary fluid chamber and said on/off valve.

15. A valve actuator assembly as set forth in claim 13 including a fluid chamber at one end of said spool valve and fluidly communicating with said feedback channel.

16. A valve actuator assembly as set forth in claim 15 including a spool valve spring disposed in said fluid chamber to bias said spool valve toward said actuator.

17. A valve actuator assembly as set forth in claim 13 wherein said actuator is of a linear type to generate linear motion.

18. A valve actuator assembly as set forth in claim 17 including a controller electrically connected to said actuator to energize and de-energize said actuator.

19. A valve actuator assembly as set forth in claim 13 including a low pressure fluid line connected to said spool valve.

20. A valve actuator assembly as set forth in claim 13 including a high pressure fluid line connected to said spool valve.

* * * * *